US008312798B2

(12) United States Patent
Kwarta et al.

(10) Patent No.: US 8,312,798 B2
(45) Date of Patent: Nov. 20, 2012

(54) SLITTER WITH TRANSLATING CUTTING DEVICES

(75) Inventors: Brian J. Kwarta, Pittsford, NY (US); James D. Shifley, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 375 days.

(21) Appl. No.: 12/781,878

(22) Filed: May 18, 2010

(65) Prior Publication Data

US 2011/0283855 A1 Nov. 24, 2011

(51) Int. Cl.
*B26D 7/06* (2006.01)

(52) U.S. Cl. ..... 83/425.3; 83/436.75; 83/508.3

(58) Field of Classification Search ..... 83/298, 83/407, 425–425.4, 436.7, 508.3, 436.75, 83/495, 498

See application file for complete search history.

(56) References Cited

U.S. PATENT DOCUMENTS

| | | | | |
|---|---|---|---|---|
| 299,982 | A * | 6/1884 | Hodgson | 83/447 |
| 3,422,714 | A * | 1/1969 | Meyer et al. | 83/498 |
| 4,215,609 | A * | 8/1980 | Coburn et al. | 83/492 |
| 4,445,409 | A * | 5/1984 | Mohr et al. | 83/157 |
| 4,604,934 | A * | 8/1986 | Elliott et al. | 83/550 |
| 4,649,782 | A * | 3/1987 | Cavagna | 83/425.4 |
| 5,378,221 | A * | 1/1995 | Lauderbaugh et al. | 493/367 |
| 5,797,830 | A * | 8/1998 | Flores et al. | 493/361 |
| 5,907,984 | A * | 6/1999 | Herman et al. | 83/24 |
| 6,469,806 | B1 * | 10/2002 | Richenderfer et al. | 358/3.21 |
| 6,627,334 | B2 * | 9/2003 | Iida et al. | 428/847 |
| 7,028,598 | B2 * | 4/2006 | Teshima | 83/879 |
| 7,134,372 | B2 * | 11/2006 | Flaherty et al. | 83/425.4 |
| 7,137,625 | B2 * | 11/2006 | Yamada et al. | 270/58.07 |
| 7,861,754 | B2 * | 1/2011 | Mitchell | 144/382 |
| 8,221,873 | B2 * | 7/2012 | Nagao et al. | 428/220 |
| 2003/0066400 | A1 * | 4/2003 | Noe et al. | 83/34 |
| 2003/0192413 | A1 * | 10/2003 | Aoki | 83/13 |
| 2003/0209115 | A1 * | 11/2003 | Burkart et al. | 83/13 |
| 2004/0016334 | A1 * | 1/2004 | Lindenblatt | 83/508.1 |
| 2004/0118260 | A1 * | 6/2004 | Lee et al. | 83/469 |
| 2005/0079968 | A1 | 4/2005 | Trovinger | |
| 2005/0217447 | A1 * | 10/2005 | Hollandsworth et al. | 83/499 |
| 2007/0000362 | A1 * | 1/2007 | Lin | 83/13 |
| 2009/0071305 | A1 * | 3/2009 | Myers et al. | 83/156 |
| 2009/0084241 | A1 * | 4/2009 | Annoura | 83/495 |

(Continued)

OTHER PUBLICATIONS

MBMCorp, BC-10 Business Card Cutter Operation Manual, Web site http://www.mbmcorp.com/pdfs/br_0818.pdf.

(Continued)

*Primary Examiner* — Sean Michalski
(74) *Attorney, Agent, or Firm* — Christopher J. White

(57) ABSTRACT

Apparatus for cutting a moving receiver includes a plurality of cutting devices and a transport mechanism for selectively moving the cutting devices perpendicular to the feed direction of the receiver. Each cutting device includes two parallel cutting wheels and a pressure wheel arranged so that the cutting wheels are pressed laterally against the pressure wheel to form two cutting areas and a chad area arranged laterally between the cutting areas. A drive mechanism rotates the cutting wheels or pressure wheel of two or more of the cutting devices so that the rotating cutting wheels engage the moving receiver to cut the moving receiver parallel to its feed direction. A controller receives a job specification including two or more specified cut locations and causes the transport mechanism to laterally position two or more of the cutting devices to cut the moving receiver in the specified cut locations.

11 Claims, 5 Drawing Sheets

U.S. PATENT DOCUMENTS

2010/0218658 A1* 9/2010 Myers et al. ..... 83/174

OTHER PUBLICATIONS

PL265 Fully Automatic Programmable Cutter, Martin Yale Industries at website http://www.martinyale.com/product_details.aspx? SKU= Intimus%20PL215%20&ReturnURL=%2fproduct_listing. aspx%3fCategory%3d1579e4d1-c382-461a-9de0-453e7a74e279%26page%3d1%26pagesize%3d10%26text%3d%26 EPCString1%3d%26EPCString2%3d%26EPCString3%3d.

CRICUT Personal Electronic Cutter, Provo Craft on line user manual at website http://www.cricut.com/res/mManual/CricutUserManual.pdf.

* cited by examiner

SLITTER WITH TRANSLATING CUTTING DEVICES

FIELD OF THE INVENTION

This invention pertains to the field of finishing printed sheets, and more particularly to such printed sheets produced using electrophotography.

BACKGROUND OF THE INVENTION

Customers of print jobs can require finishing steps for their jobs. These steps include, for example, folding printed or blank sheets, cutting sheets and trimming sheets to size and shape. For example, when producing business cards, the cards are printed on a large sheet of stiff card stock. After printing, individual cards are produced by cutting the sheets of cards into individual business cards.

Conventional finishing equipment is typically not suited for use in consumer occupied environments such as stores or business establishments, and typically requires trained personnel to safely and effectively use it. Cutters typically include large guillotines that use heavy impacts to cut through thick stacks of paper. For example, the INTIMUS PL265 programmable cutter by MARTIN YALE of Wabash, Ind., cuts up to a 2⅞" stack of paper and weighs 823 lbs. There is a need, therefore, for smaller, lighter finishing equipment to incorporate into devices used by consumers at home or in retail environments. Furthermore, unlike offset presses which run a large number of copies of a single print job, digital printers can produce small numbers of copies of a job, requiring more frequent changes to the finishing sequence. In some cases, each printed page must be finished individually. Moreover, the PL265 cutter can only store 10cutting programs, so cannot produce more than 10 cut patterns without manual intervention. There is a need, therefore, for flexible and programmable finishing equipment that can finish each page individually without manual intervention.

The CRICUT cutter by PROVO CRAFT can cut shapes into individual sheets of paper. However, the machine requires manual loading and unloading. Furthermore, the CRICUT moves the sheet to be cut back and forth during cutting, making it unsuitable for high-volume applications that need continuous-speed sheet transport.

U.S. Publication No. 2005/0079968 to Trovinger describes a sheet folding and trimming apparatus adapted to fold a sheet, trim three edges of the sheet square with the fold, and assemble the folded and trimmed sheets into a booklet. However, this apparatus trims the sides with fixed cutters not suitable for continuous-web operation.

There is a continuing need, therefore, for a way of flexibly cutting sheets in small, customizable finishers.

SUMMARY OF THE INVENTION

In accordance with the present invention, there is provided apparatus for cutting a moving receiver, comprising:

a. a plurality of cutting devices, each comprising two parallel cutting wheels and a pressure wheel arranged so that the cutting wheels are pressed laterally against the pressure wheel to form two cutting areas and a chad area arranged laterally between the cutting areas;

b. a drive mechanism for rotating the cutting wheels or pressure wheel of two or more of the plurality of cutting devices so that the rotating cutting wheels engage the moving receiver to cut the moving receiver parallel to its feed direction in the cutting areas, whereby one or more chads are cut out of the receiver;

c. a transport mechanism for selectively moving the plurality of cutting devices perpendicular to the feed direction of the receiver; and d. a controller for receiving a job specification including two or more specified cut locations and causing the transport mechanism to laterally position two or more of the plurality of cutting devices to cut the moving receiver in the specified cut locations.

An advantage of this invention is that it uses small, light, inexpensive cutting machinery that can be used in environments without enough space for prior-art machines, or that require unskilled operators be able to use the machinery. The invention can emit less audible noise while operating due to its reduced power draw compared to guillotine cutters. It can finish each sheet of a print job individually without manual intervention. It can be employed with continuous-feed printing systems. It diverts the chad flow from the output flow, simplifying operation and cleanup.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
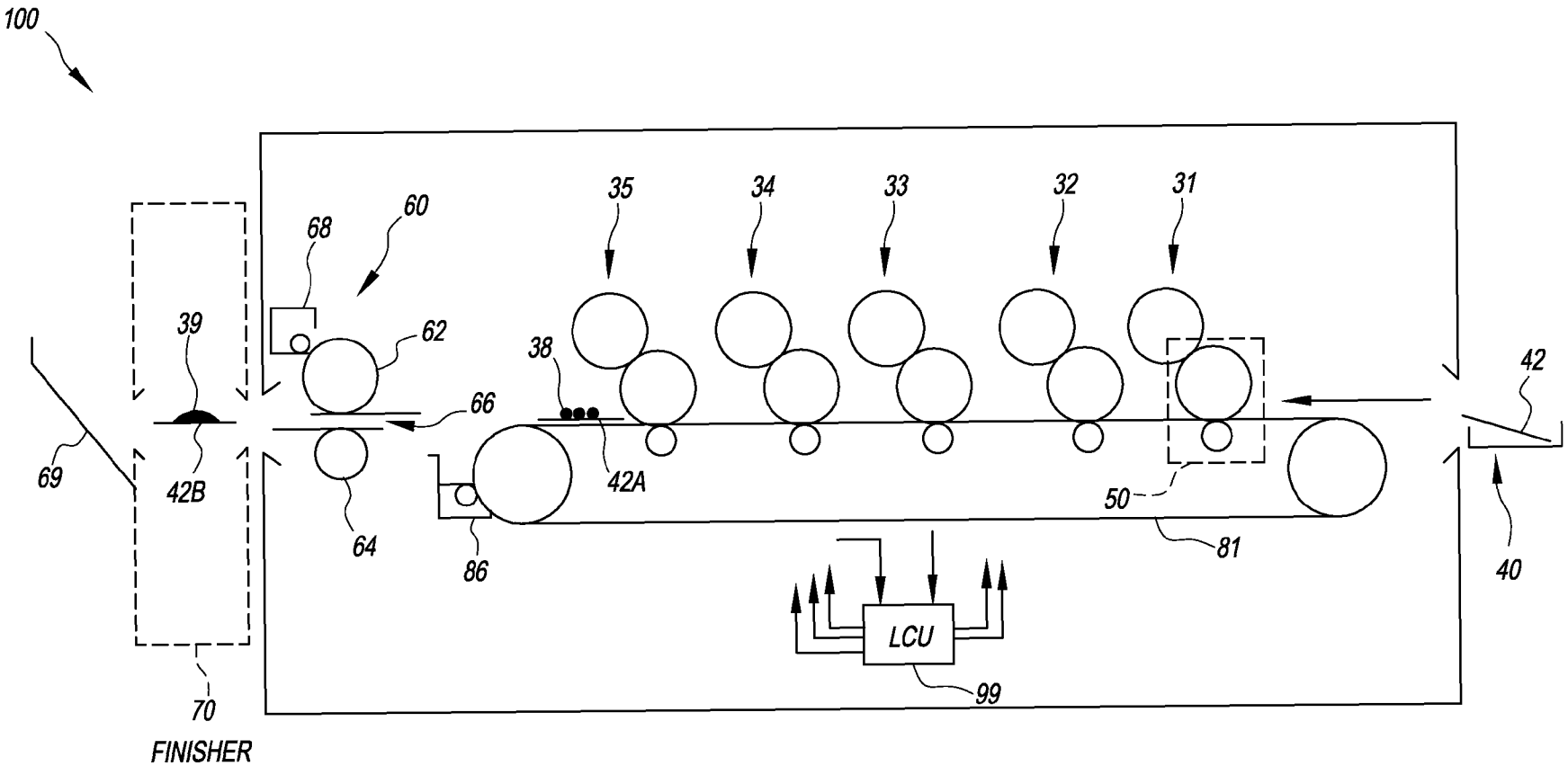
FIG. 1 is an elevational cross-section of an electrophotographic reproduction apparatus suitable for use with this invention.

The attached drawings are for purposes of illustration and are not necessarily to scale.

DETAILED DESCRIPTION OF THE INVENTION

As used herein, the terms "parallel" and "perpendicular" have a tolerance of ±1°. In preferred embodiments, parallel and perpendicular structures have a tolerance of ±0.17° (±1 mm over 13"), or ±0.07° (±1 mm over 32")

As used herein, "sheet" is a discrete piece of media, such as receiver media for an electrophotographic printer (described below). Sheets have a length and a width. Sheets are folded along fold axes, e.g. positioned in the center of the sheet in the length dimension, and extending the full width of the sheet. The folded sheet contains two "leaves," each leaf being that portion of the sheet on one side of the fold axis. The two sides of each leaf are referred to as "pages." "Face" refers to one side of the sheet, whether before or after folding. "Inboard" refers to closer to the center of a receiver; "outboard" refers to farther from the center of a receiver.

In the following description, some embodiments of the present invention will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, the method in accordance with the present invention.

Other aspects of such algorithms and systems, and hardware or software for producing and otherwise processing the image signals involved therewith, not specifically shown or described herein, are selected from such systems, algorithms, components, and elements known in the art. Given the system as described according to the invention in the following, software not specifically shown, suggested, or described herein that is useful for implementation of the invention is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method according to the present invention.

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, toner particles having a charge substantially opposite to the charge of the latent image are brought into the vicinity of the photoreceptor so as to be attracted to the latent image to develop the latent image into a visible image. Note that the visible image may not be visible to the naked eye depending on the composition of the toner particles (e.g. clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g. of separations of different colors, are overlaid on one receiver before fusing to form a multi-color print image on the receiver.

Electrophotographic (EP) printers typically transport the receiver past the photoreceptor to form the print image. The direction of travel of the receiver is referred to as the slow-scan or process direction. This is typically the vertical (Y) direction of a portrait-oriented receiver. The direction perpendicular to the slow-scan direction is referred to as the fast-scan or cross-process direction, and is typically the horizontal (X) direction of a portrait-oriented receiver. "Scan" does not imply that any components are moving or scanning across the receiver; the terminology is conventional in the art.

The electrophotographic process can be embodied in devices including printers, copiers, scanners, and facsimiles, and analog or digital devices, all of which are referred to herein as "printers." Various aspects of the present invention are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine useful with the present invention, e.g. the NEXPRESS 2100 printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for the transfer to the receiver of individual print images. Of course, in other electrophotographic printers, each print image is directly transferred to a receiver.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

FIG. 1 is an elevational cross-section showing portions of a typical electrophotographic printer 100 useful with the present invention. Printer 100 is adapted to produce images, such as single-color (monochrome), CMYK, or pentachrome (five-color) images, on a receiver (multicolor images are also known as "multi-component" images). Images can include text, graphics, photos, and other types of visual content. One embodiment of the invention involves printing using an electrophotographic print engine having five sets of single-color image-producing or -printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to a receiver. The receiver is, for example, a selected section of a web of, or a cut sheet of, planar media such as paper or transparency film.

Each receiver, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g. metallic, fluorescent, or pearlescent colors), or a clear toner.

Receiver 42A is shown after passing through printing module 35. Print image 38 on receiver 42A includes unfused toner particles.

Subsequent to transfer of the respective print images, overlaid in registration, one from each of the respective printing modules 31, 32, 33, 34, 35, the receiver is advanced to a fuser 60, i.e. a fusing or fixing assembly, to fuse the print image to the receiver. Transport web 81 transports the print-image-carrying receivers to fuser 60, which fixes the toner particles to the respective receivers by the application of heat and pressure. The receivers are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed with the present invention. For example, solvent fixing uses solvents to soften the toner particles so they bond with the receiver. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers (e.g. receiver 42B) carrying the fused image (e.g. fused image 39) are transported in a series from the fuser 60 along a path either to a remote output tray 69, or back to printing modules 31 et seq. to create an image on the backside of the receiver, i.e. to form a duplex print. Receivers can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various paper-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003, by Peter S. Alexandrovich et al., and in U.S. Publication No. 2006/0133870, published on Jun. 22, 2006, by Yee S. Ng et al., the disclosures of which are incorporated herein by reference.

Figure 2:
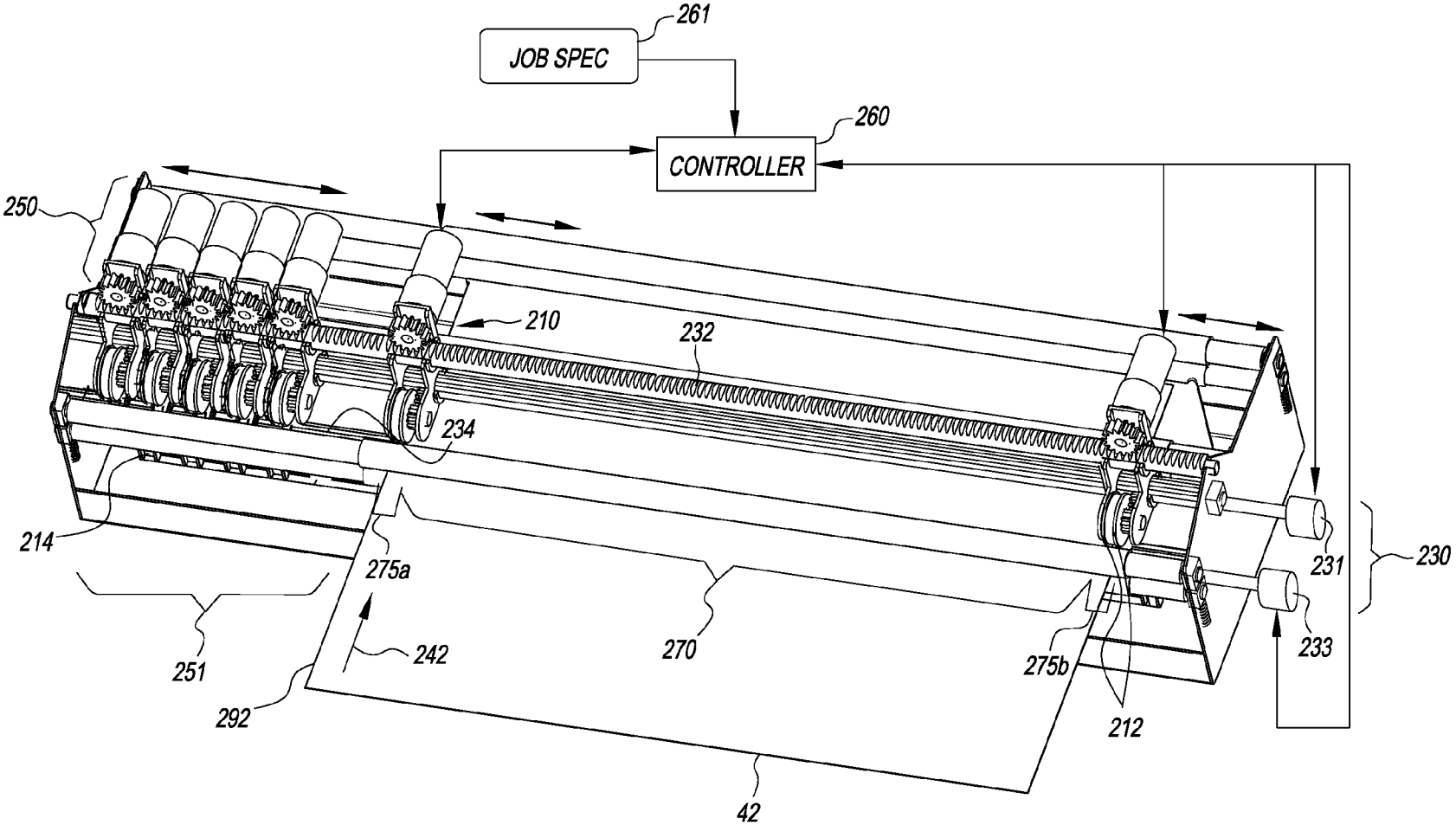
FIGS. 2 and 3 are isometric views of cutting apparatus according to an embodiment of the present invention.

FIG. 2 is an isometric view of cutting apparatus according to an embodiment of the present invention. FIG. 2 shows the apparatus configured for 1-up cutting, in which a narrow edge strip is trimmed of each longitudinal edge. This permits full-bleed output from an electrophotographic printer.

As used herein, "n-up," for some integer n, means cutting receiver 42 into n non-chad sections along cutting axes parallel to the feed direction 242 of receiver 42. This is discussed further below. Non-chad sections are sections intended to be provided to a customer or user of printer 100 (FIG. 1). Chad is intended to be discarded or recycled external to printer 100. The operation of lengthwise cutting is referred to as "slitting." Between each of the n non-chad sections, and between the outermost two non-chad sections and the corresponding edges of receiver 42, is a chad strip. The chad strips at the edges are the areas of receiver 42 which cannot be printed by a printing module (e.g. printing module 31, FIG. 1). The chad strips not at the edges of receiver 42 remove the areas of receiver 42 between different images to provide clean full-bleed output on each non-chad section. Each non-chad section can have a width the same as or different than the widths of the other non-chad sections.

The apparatus for cutting (specifically, slitting, so referred to as a "slitter") a moving receiver 42 includes a plurality of cutting devices 210, here seven in number. Each cutting device 210 includes two parallel cutting wheels 212 and a pressure wheel 214 arranged so that the cutting wheels 212 are pressed laterally against the pressure wheel 214 to form two cutting areas and a chad area arranged laterally between the cutting areas. This is discussed further below with reference to FIGS. 4A and 4B.

Drive mechanism 230 rotates the cutting wheels 212 or pressure wheel 214 of two or more of the cutting devices 210 so that the rotating cutting wheels 212 engage the moving receiver 42 to cut the moving receiver 42 parallel to its feed direction 242 in the cutting areas. One or more chads are thus cut out of the receiver between the cutting wheels of each cutting device. As shown here, one chad is cut off each edge. The chad can be a long strip of the material of receiver 42.

Figure 3:
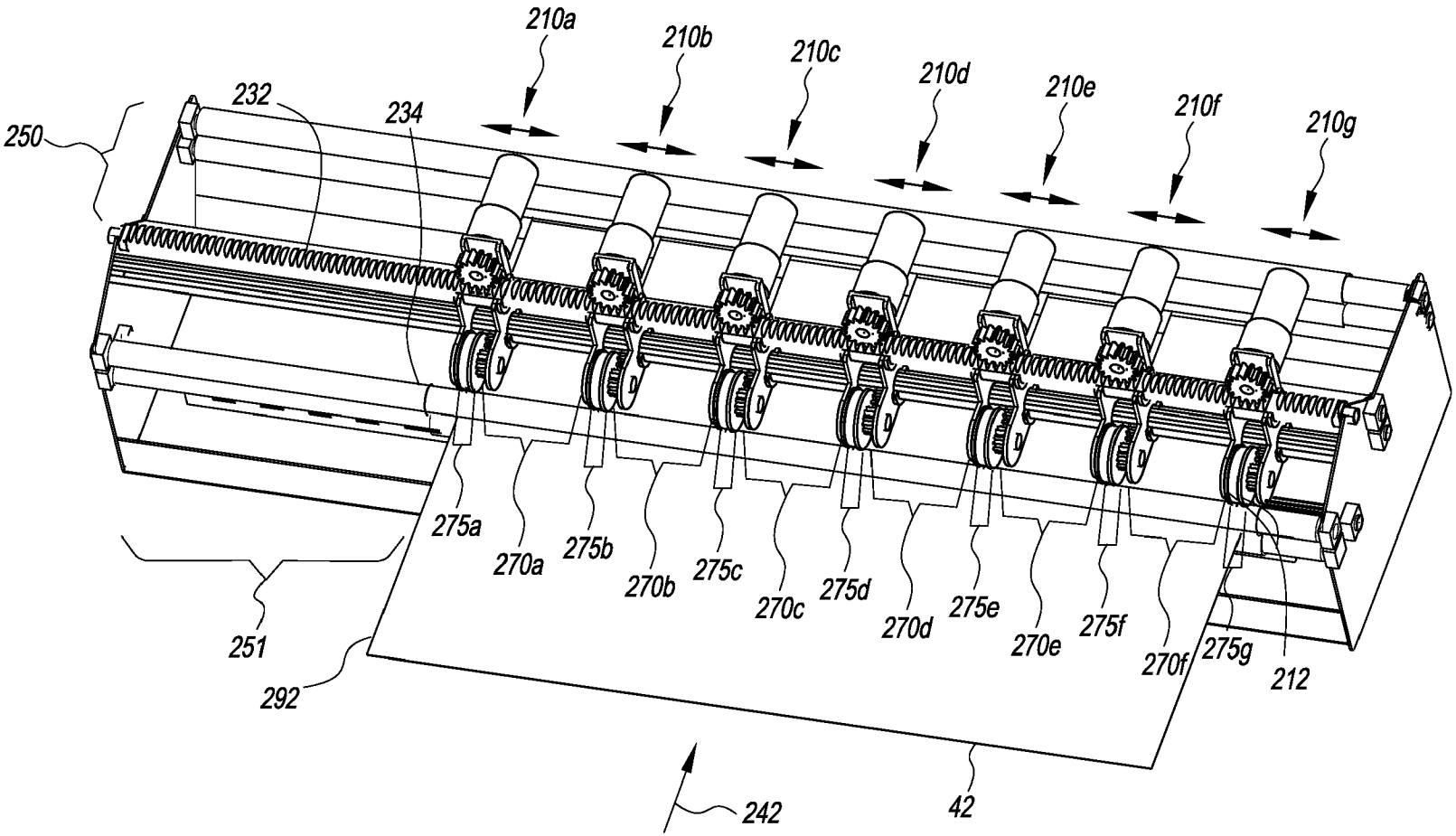

Transport mechanism 250 selectively translates the cutting devices 210, i.e. moves the cutting devices 210 perpendicular to feed direction 242 of receiver 42, to permit adjustment of the location and number of cuts. FIG. 3, discussed below, shows an example of 6-up cutting.

Controller 260 receives a job specification 261 including two or more specified cut locations and causes transport mechanism 250 to laterally position two or more of the cutting devices 210 to cut the moving receiver 42 in the specified cut locations. This is discussed further below with reference to FIG. 4A. For 1-up cutting, non-chad area 270 is the printed page to be retained, and chad areas 275*a*, 275*b* are to be discarded.

In an embodiment, drive mechanism 230 rotates the cutting wheels 212. Cutting devices 210, and specifically cutting wheels 212, are mounted on shaft 232, along which transport mechanism 250 selectively moves cutting wheels 212. Drive mechanism 230 drives shaft 232 to provide energy to rotate cutting wheels 212. Pressure wheel 214 is rotated by friction with the rotating cutting wheels 212. A non-chad area is defined between each adjacent pair of cutting wheels 212.

In another embodiment, drive mechanism 230 rotates the pressure wheel 214. Pressure wheel 214 is mounted on shaft 234, along which transport mechanism 250 selectively moves pressure wheel 214. Drive mechanism 230 drives shaft 234 to provide energy to rotate pressure wheel 214. Cutting wheels 212 are rotated by friction with the rotating pressure wheel 214.

In yet another embodiment, both cutting wheels 212 and pressure wheel 214 are mounted on driven shafts, and drive mechanism 230 drives both shafts.

In an embodiment, drive mechanism 230 includes motor 231 for driving shaft 232 and motor 233 for driving shaft 234. Motors 231, 233 are controlled by controller 260, and can include encoders to report position back to controller 260. Stepper or servomotors can be used.

In various embodiments, the driven shaft(s) 232, 234 extend beyond edge 292 of receiver 42 into area 251. Transport mechanism 250 is adapted to move at least one of the cutting devices 210 beyond the edge 292 of receiver 42. This permits adjustment of the number of cuts: for n-up printing, the number of cutting devices 210 positioned over receiver 42 is n+1. All cutting devices 210 not required for n-up cutting are positioned off receiver 42 in area 251.

FIG. 3 is an isometric view of a cutting apparatus according to an embodiment of the present invention. FIG. 3 shows the apparatus configured for 6-up cutting, in which receiver 42 is slit into six strips. This is useful e.g. for business-card printing, in which each strip is one business card wide. Cutting wheels 212, pressure wheel 214, shaft 232, shaft 234, receiver 42, feed direction 242, transport mechanism 250, area 251, and edge 292 are as shown in FIG. 2. Each cutting device 210*a*-210*g* corresponds to cutting device 210 of FIG.

In this embodiment, all seven cutting devices, 210*a*-210*g*, are positioned over receiver 42. Cutting devices 210*a* and 210*g* are at the edges of receiver 42, to trim those edges and permit full-bleed output. Cutting devices 210*b*-210*f* are disposed over the internal area of receiver 42, i.e. receiver 42 extends perpendicular to feed direction 242 on both sides of each cutting device 210*b*-210*f*. Cutting devices 210*a*-210*g* define respective chad areas 275*a*-275*g*. Between the cutting devices are non-chad areas 270*a*-270*f*, which can be chopped (cut perpendicular to feed direction 242) to form business cards.

Figure 4A:
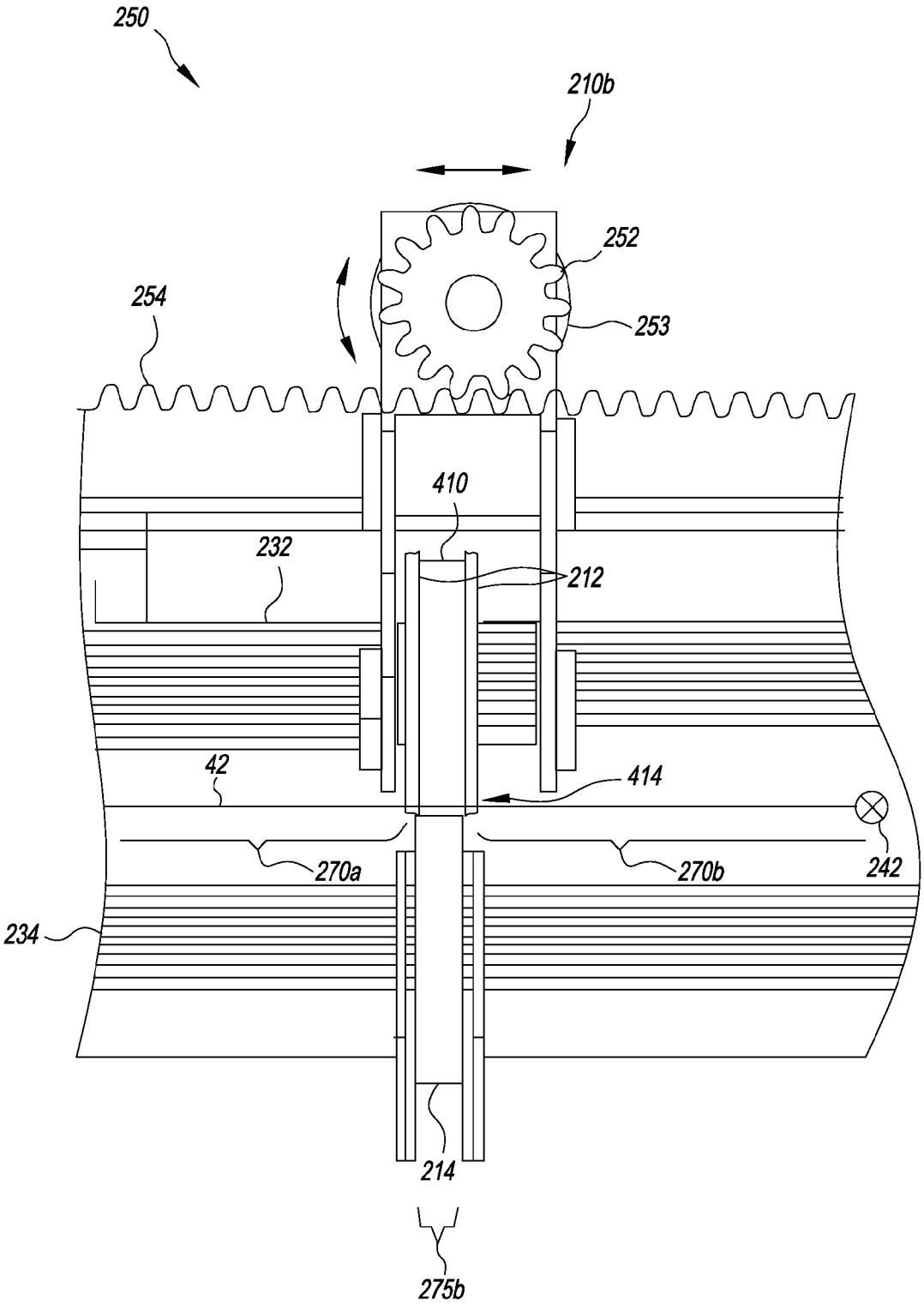
FIGS. 4A and 4B are front and side views, respectively, of a cutting device according to an embodiment of the present invention.

FIG. 4A is a front view of a cutting device according to an embodiment of the present invention. Receiver 42 is shown travelling in feed direction 242, into the plane of the image. Cutting device 210*b*, cutting wheels 212, pressure wheel 214, shaft 234, and shaft 232 are as shown in FIGS. 2 and 3. Non-chad areas 270*a* and 270*b* on each side of cutting wheels 212 are as shown in FIG. 3. Chad area 275*b* is as shown in FIG. 3. All cutting devices 210, 210*a*-210*g* are the same, so this figure is representative of cutting devices besides cutting device 210*b*.

As receiver 42 passes through cutting device 210*b* in feed direction 242, it is divided into three pieces: non-chad area 270*a*, chad area 275*b*, and non-chad area 270*b*.

In an embodiment, the surface of pressure wheel 214 of each cutting device 210 is harder than the surface of the cutting wheels 212. This provides a self-sharpening action, in which contact with pressure wheel 214 while cutting sharpens cutting wheels 212. Hardness can be measured on a Shore A durometer or other hardness scales known in the art.

In another embodiment, pressure wheel 214 of each cutting device 210 is harder than cutting wheels 212. For example, the bulk material of pressure wheel 214 can be harder throughout than the bulk material of cutting wheels 212. This also provides a self-sharpening action, in which contact with pressure wheel 214 while cutting sharpens cutting wheels 212.

In an embodiment, friction member 410 is disposed between the cutting wheels 212 of one of the cutting devices 210*b*. Friction member 410 is adapted to draw receiver 42 through cutting device 210*b*. For example, friction member 410 and pressure wheel 214 of cutting device 210*b* can form a nip 414 through which the moving receiver 42 is drawn. In various embodiments, friction member 410 is a compliant rotatable coaxial friction device such as a belt, roller, vacuum belt, or o-rings disposed between cutting blades 212 for positively driving receiver 42 through cutting device 210.

Transport mechanism 250 includes rack 254 and pinion 252. Pinion 252 is driven by motor 253 to move cutting device 210 to a selected position with respect to receiver 42. Controller 260 (FIG. 2) provides power or drive commands to motor 253. Motor 253 can be a servomotor or stepper motor, and can include an encoder for position sensing and a transceiver for reporting position information to the controller. The terminals of the armature of motor 253 can be shorted to provide braking action to hold cutting device 210 in place while it is not being moved.

Referring back to FIG. 3, in an embodiment, not all cutting devices have motors 253. In one example, cutting devices 210*a* and 210*c* have motors 253 and cutting device 210*b* does not. Cutting device 210*b* is moved to the right by pushing it with cutting device 210*a* and is moved to the left by pushing it with cutting device 210*c*. Similarly, cutting devices 210*a*, 201*c*, 210*e*, and 210*g* can have motors 253, and cutting devices 210*b*, 210*d*, and 210*f* can lack motors 253. Cutting devices without motors can include friction elements or clutches to hold them in position when they are not being pushed.

Still referring back to FIG. 3, in various embodiments, cutting devices 210 positioned at the edges of receiver 42 (e.g. cutting devices 210*a*, 210*g*) can have only a single cutting wheel, or the outboard cutting wheels 212 of cutting devices 210*a*, 210*g* can be positioned off receiver 42. If both cutting wheels 212 of cutting devices 210, 210*g* are positioned over receiver 42, additional chad areas are cut outboard of chad areas 275*a*, 275*g*.

Figure 4B:
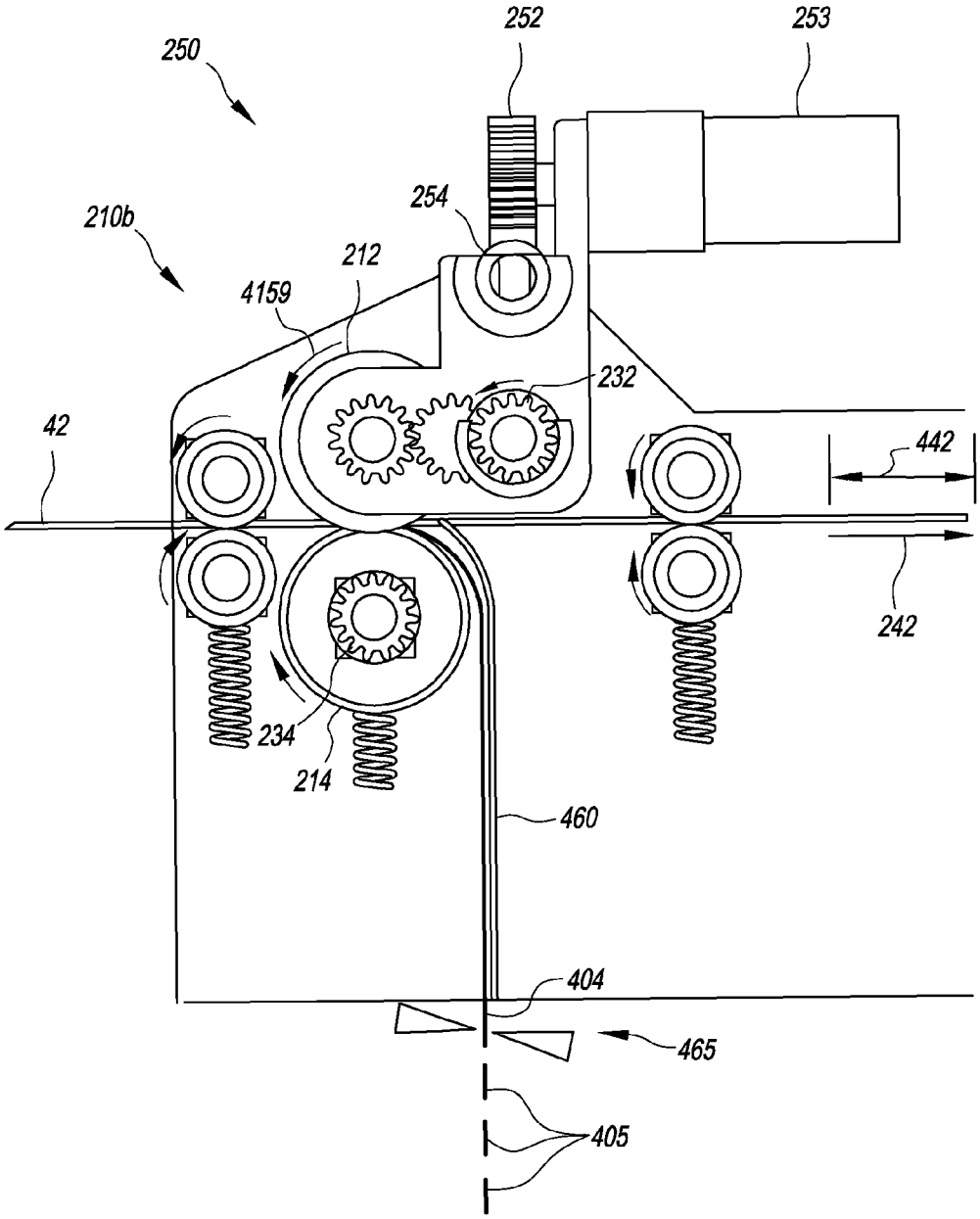
Figure 4A:
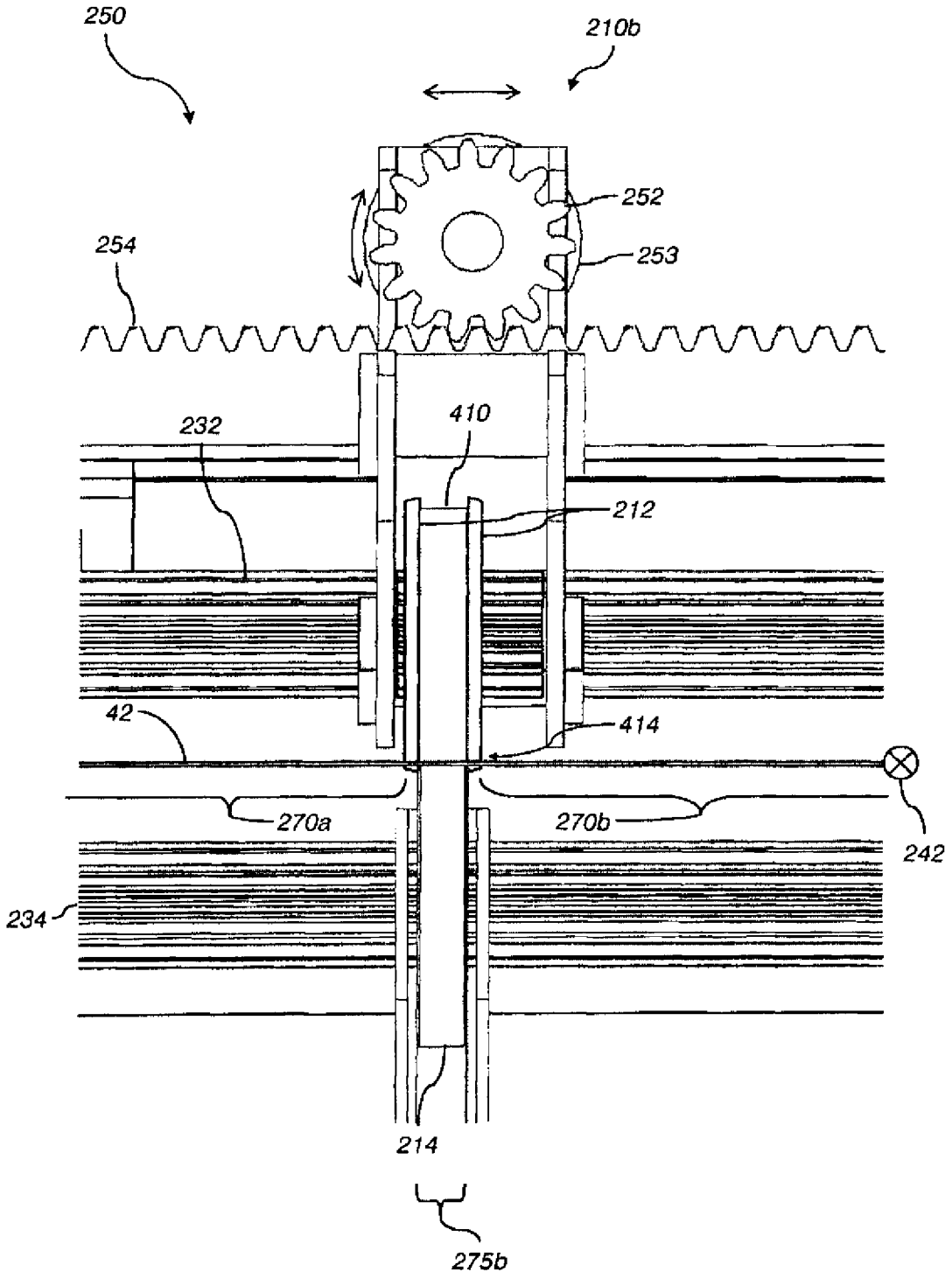

FIG. 4B is a side view of a cutting device according to an embodiment of the present invention. Cutting device 210, cutting wheels 212, receiver 42, feed direction 242, shafts 232, 234, pressure wheel 214, rack 251, pinion 252, and motor 253 are as shown in FIG. 4A. Cutting wheels 212 turn with circumferential speed 4159, which is the magnitude of linear velocity at the outer circumference of the wheel. In an embodiment, circumferential speed 4159 of cutting wheels 212 is at most 15% greater than the speed 442 (shown as the magnitude of the velocity vector of feed direction 242) of receiver 42 in feed direction 242. This advantageously provides positive take-up of receiver 42 and maintains tension with reduced risk of tearing receiver 42. In other embodiments, circumferential speed 4159 is less than, equal to, or greater than the speed of receiver 42 in feed direction 42.

In an embodiment, at least one of the cutting devices 210 includes deflector 460. Deflector 460 is laterally disposed in chad area 275*b* (FIG. 4A) of cutting device 210*b* and extends through the plane of receiver 42. Deflector 460 engages the chad as receiver 42 moves and directs the chad away from feed direction 242 of receiver 42. Receiver 42 can have folds, creases, and wrinkles, and still define a plane. The plane of receiver 42 can be defined as the best-fit plane of all possible vectors from one point of receiver 42 to another in the area of receiver 42 between cutting wheels 212 and pressure wheel 214.

In an embodiment, chad chopper 465, represented graphically here as a pair of scissor blades, is disposed to receive the chad 404. Chad 404 is a continuous strip of material cut out of receiver 42. Chad chopper 465 chops chad 404 into chad pieces 405 for easier handling and disposal. Chad chopper 465 can be automatic scissors, a guillotine, an ulu, a laser, or another cutting device known in the art. Deflector 460 and chad chopper 465 advantageously separate chad-handling structures from non-chad-handling structures, permitting simplified structures for both.

Other embodiments of transport mechanism 250 can be employed. Some are described herein; others will be obvious to those skilled in the art. The embodiments below are not shown, but refer to parts on FIG. 2.

In an embodiment, transport mechanism 250 includes a guide rod having a helical groove, and at least one carriage corresponding to one of the cutting devices 210. Each carriage includes a support that rides on the guide rod, two side walls attached to the support and adapted to retain the corresponding cutting device in lateral position with respect to the support, a pin for selectively mechanically engaging the support to the helical groove, so that the support translates along the length of the guide rod when the guide rod rotates, and an actuator responsive to the controller for causing the pin to engage.

In another embodiment, transport mechanism 250 includes a magnetic-levitation (maglev) track along which cutting devices 210 move. Examples of a maglev system useful with the present invention include those described in U.S. Pat. No. 7,617,779, issued Nov. 17, 2009 to Studer, and U.S. Pat. No. 6,357,359, issued Mar. 19, 2002 to Davey et al., the disclosures of both of which are incorporated herein by reference.

In another embodiment, transport mechanism 250 includes a cable, belt, or timing belt entrained around a drive pulley, and each cutting device 210 includes a grapple for selectively mechanically connecting the cutting device to the cable or belt. To move a cutting device 210, controller 260 causes cutting device 210 to engage its grapple and thereby connect itself to the cable or belt. The controller then activates a drive motor to rotate the drive pulley, and move each point of the cable around a loop. The cutting device that is connected to the cable or belt will move with the cable or belt. This is similar to the drive mechanism of a cable car or of an inkjet printer carriage.

In another embodiment, transport mechanism 250 includes a ferromagnetic or other magnetic or ferrous cable or belt entrained around a drive pulley, and each cutting device 210 includes a magnetic grapple for selectively attracting the cable or belt. A grapple useful with the present invention is described in U.S. Pat. No. 5,525,950, issued Jun. 11, 1996 to Wang, the disclosures of which are incorporated herein by reference. To move a cutting device 210, controller 260 causes cutting device 210 to engage its grapple and thereby attach itself magnetically to the cable or belt. The controller then activates a drive motor to rotate the drive pulley, and move each point of the cable around a loop. The cutting device that is attached to the cable or belt will move with the cable or belt.

In another embodiment, a telescoping pushrod with a key can be used to selectively engage a cutting device 210 and push or pull it. In another embodiment, a rack and pinion can be employed, where the rack is an integral part of the rod supporting cutting devices 210 rather than a separate part.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

31, 32, 33, 34, 35 printing module
38 print image
39 fused image
40 supply unit
42, 42A, 42B receiver
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)
100 printer
210, 210*a*, 210*b*, 210*c*, 210*d*, 210*e*, 210*f*, 210*g* cutting device
212 cutting wheel
214 pressure wheel
230 drive mechanism
231 motor
232 shaft
233 motor
234 shaft
242 feed direction
250 transport mechanism
251 area
252 pinion
253 motor
254 rack
260 controller
261 job specification
270, 270*a*, 270*b*, 270*c*, 270*d*, 270*e*, 270*f* non-chad area
275*a*, 275*b*, 275*c*, 275*d*, 275*e*, 275*f*, 275*g* chad area
292 edge of the receiver
404 chad
405 chad piece
410 friction member
414 nip
442 speed of the receiver
444 plane of the receiver
460 deflector
465 chad chopper
4159 circumferential speed

The invention claimed is:

1. Apparatus for cutting a moving receiver comprising:

a. a plurality of cutting devices, each comprising two parallel cutting wheels and a pressure wheel arranged so that the cutting wheels are pressed laterally against the pressure wheel to form two cutting areas and a chad area arranged laterally between the cutting areas;

b. a drive mechanism for rotating the cutting wheels or pressure wheel of two or more of the plurality of cutting devices so that the rotating cutting wheels engage the moving receiver to cut the moving receiver parallel to its feed direction in the cutting areas, whereby one or more chads are cut out of the receiver;

c. a transport mechanism for selectively moving the plurality of cutting devices perpendicular to the feed direction of the receiver; and d. a controller for receiving a job specification including two or more specified cut locations and causing the transport mechanism to laterally position two or more of the plurality of cutting devices to cut the moving receiver in the specified cut locations.

2. The apparatus according to claim 1, wherein a surface of the pressure wheel of each of the plurality of cutting devices is harder than a surface of the cutting wheels.

3. The apparatus according to claim 1, wherein the pressure wheel of each of the plurality of cutting devices is harder than the cutting wheels.

4. The apparatus according to claim 1, wherein the drive mechanism rotates the cutting wheels, further comprising:

e. A shaft on which the cutting wheels are mounted and along which the transport mechanism selectively moves the cutting wheels.

5. The apparatus according to claim 4, wherein the shaft extends beyond the edge of the receiver and the transport mechanism is adapted to move at least one of the cutting devices beyond the edge of the receiver.

6. The apparatus according to claim 1, wherein the drive mechanism rotates the pressure wheels of two or more of the plurality of cutting devices, further comprising:

e. a shaft on which the pressure wheels are mounted and along which the transport mechanism selectively moves the pressure wheels.

7. The apparatus according to claim 6, wherein the shaft extends beyond the edge of the receiver and the transport mechanism is adapted to move at least one of the plurality of cutting devices beyond the edge of the receiver.

8. The apparatus according to claim 1, further including a friction member disposed between the cutting wheels of one of the plurality of cutting devices and adapted to draw the receiver through the plurality of cutting devices.

9. The apparatus according to claim 8, wherein the friction member and the pressure wheel of the corresponding cutting device form a nip through which the moving receiver is drawn.

10. The apparatus according to claim 1, wherein the circumferential speed of the cutting wheels is at most 15% greater than the speed of the receiver in its feed direction.

11. The apparatus according to claim 1, wherein at least one of the plurality of cutting devices includes a deflector laterally disposed in the chad area of the at least one of the plurality of cutting devices and extending through the plane of the receiver, so that the deflector engages the chad as the receiver moves and directs the chad away from the feed direction of the receiver.

* * * * *

UNITED STATES PATENT AND TRADEMARK OFFICE

CERTIFICATE OF CORRECTION

PATENT NO. : 8,312,798 B2
APPLICATION NO. : 12/781878
DATED : November 20, 2012
INVENTOR(S) : Brian J. Kwarta et al.

It is certified that error appears in the above-identified patent and that said Letters Patent is hereby corrected as shown below:

Delete the title page showing an illustrative figure and substitute the attached title page therefor.

In the Drawings

Delete drawing sheet 4 of 5, and substitute the attached drawing sheet 4 of 5 therefor.

Signed and Sealed this
Fourth Day of November, 2014

Michelle K. Lee

Michelle K. Lee
*Deputy Director of the United States Patent and Trademark Office*

(12) United States Patent
Kwarta et al.

(10) Patent No.: US 8,312,798 B2
(45) Date of Patent: Nov. 20, 2012

(54) SLITTER WITH TRANSLATING CUTTING DEVICES

(75) Inventors: Brian J. Kwarta, Pittsford, NY (US); James D. Shifley, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 375 days.

(21) Appl. No.: 12/781,878

(22) Filed: May 18, 2010

(65) Prior Publication Data

US 2011/0283855 A1 Nov. 24, 2011

(51) Int. Cl.
*B26D 7/06* (2006.01)

(52) U.S. Cl. ..... 83/425.3; 83/436.75; 83/508.3

(58) Field of Classification Search ..... 83/298, 83/407, 425–425.4, 436.7, 508.3, 436.75, 83/495, 498

See application file for complete search history.

(56) References Cited

U.S. PATENT DOCUMENTS

| | | | | |
|---|---|---|---|---|
| 299,982 | A * | 6/1884 | Hodgson | 83/447 |
| 3,422,714 | A * | 1/1969 | Meyer et al. | 83/498 |
| 4,215,609 | A * | 8/1980 | Coburn et al. | 83/492 |
| 4,445,409 | A * | 5/1984 | Mohr et al. | 83/157 |
| 4,604,934 | A * | 8/1986 | Elliott et al. | 83/550 |
| 4,649,782 | A * | 3/1987 | Cavagna | 83/425.4 |
| 5,378,221 | A * | 1/1995 | Lauderbaugh et al. | 493/367 |
| 5,797,830 | A * | 8/1998 | Flores et al. | 493/361 |
| 5,907,984 | A * | 6/1999 | Herman et al. | 83/24 |
| 6,469,806 | B1 * | 10/2002 | Richenderfer et al. | 358/3.21 |
| 6,627,334 | B2 * | 9/2003 | Iida et al. | 428/847 |
| 7,028,598 | B2 * | 4/2006 | Teshima | 83/879 |
| 7,134,372 | B2 * | 11/2006 | Flaherty et al. | 83/425.4 |
| 7,137,625 | B2 * | 11/2006 | Yamada et al. | 270/58.07 |
| 7,861,754 | B2 * | 1/2011 | Mitchell | 144/382 |
| 8,221,873 | B2 * | 7/2012 | Nagao et al. | 428/220 |
| 2003/0066400 | A1 * | 4/2003 | Noe et al. | 83/34 |
| 2003/0192413 | A1 * | 10/2003 | Aoki | 83/13 |
| 2003/0209115 | A1 * | 11/2003 | Burkart et al. | 83/13 |
| 2004/0016334 | A1 * | 1/2004 | Lindenblatt | 83/508.1 |
| 2004/0118260 | A1 * | 6/2004 | Lee et al. | 83/469 |
| 2005/0079968 | A1 | 4/2005 | Trovinger | |
| 2005/0217447 | A1 * | 10/2005 | Hollandsworth et al. | 83/499 |
| 2007/0000362 | A1 * | 1/2007 | Lin | 83/13 |
| 2009/0071305 | A1 * | 3/2009 | Myers et al. | 83/156 |
| 2009/0084241 | A1 * | 4/2009 | Annoura | 83/495 |

(Continued)

OTHER PUBLICATIONS

MBMCorp, BC-10 Business Card Cutter Operation Manual, Web site http://www.mbmcorp.com/pdfs/br_0818.pdf.

(Continued)

*Primary Examiner* — Sean Michalski
(74) *Attorney, Agent, or Firm* — Christopher J. White

(57) ABSTRACT

Apparatus for cutting a moving receiver includes a plurality of cutting devices and a transport mechanism for selectively moving the cutting devices perpendicular to the feed direction of the receiver. Each cutting device includes two parallel cutting wheels and a pressure wheel arranged so that the cutting wheels are pressed laterally against the pressure wheel to form two cutting areas and a chad area arranged laterally between the cutting areas. A drive mechanism rotates the cutting wheels or pressure wheel of two or more of the cutting devices so that the rotating cutting wheels engage the moving receiver to cut the moving receiver parallel to its feed direction. A controller receives a job specification including two or more specified cut locations and causes the transport mechanism to laterally position two or more of the cutting devices to cut the moving receiver in the specified cut locations.

11 Claims, 5 Drawing Sheets

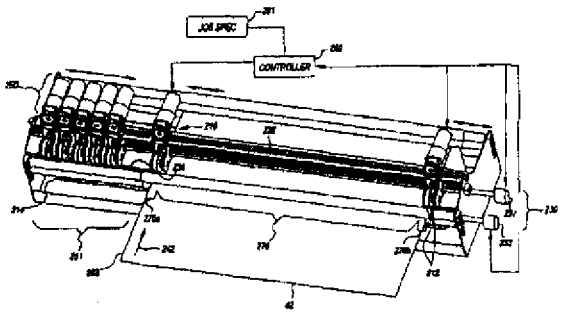

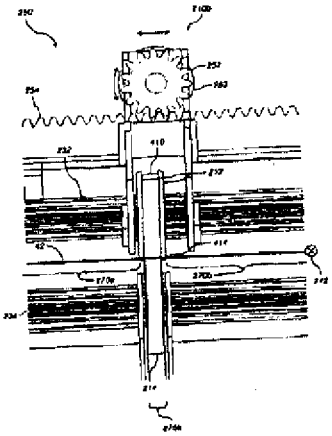

US008312798C1

(12) EX PARTE REEXAMINATION CERTIFICATE (10438th)

United States Patent
Kwarta et al.

(10) Number: US 8,312,798 C1
(45) Certificate Issued: Dec. 15, 2014

(54) SLITTER WITH TRANSLATING CUTTING DEVICES

(75) Inventors: Brian J. Kwarta, Pittsford, NY (US); James D. Shifley, Spencerport, NY (US)

(73) Assignee: Wilmington Trust, National Association, Minneapolis, MN (US)

Reexamination Request:
No. 90/012,867, May 15, 2013

Reexamination Certificate for:

| | |
|---|---|
| Patent No.: | **8,312,798** |
| Issued: | **Nov. 20, 2012** |
| Appl. No.: | **12/781,878** |
| Filed: | **May 18, 2010** |

Certificate of Correction issued Nov. 4, 2014

(51) Int. Cl.
*B26D 7/06* (2006.01)
*B26D 1/22* (2006.01)

(52) U.S. Cl.
CPC ..... *B26D 1/225* (2013.01); *B31B 2201/146* (2013.01)
USPC ..... 83/425.3; 83/436.75; 83/508.3

(58) Field of Classification Search
None
See application file for complete search history.

(56) References Cited

To view the complete listing of prior art documents cited during the proceeding for Reexamination Control Number 90/012,867, please refer to the USPTO's public Patent Application Information Retrieval (PAIR) system under the Display References tab.

*Primary Examiner* — Peter C English

(57) ABSTRACT

Apparatus for cutting a moving receiver includes a plurality of cutting devices and a transport mechanism for selectively moving the cutting devices perpendicular to the feed direction of the receiver. Each cutting device includes two parallel cutting wheels and a pressure wheel arranged so that the cutting wheels are pressed laterally against the pressure wheel to form two cutting areas and a chad area arranged laterally between the cutting areas. A drive mechanism rotates the cutting wheels or pressure wheel of two or more of the cutting devices so that the rotating cutting wheels engage the moving receiver to cut the moving receiver parallel to its feed direction. A controller receives a job specification including two or more specified cut locations and causes the transport mechanism to laterally position two or more of the cutting devices to cut the moving receiver in the specified cut locations.

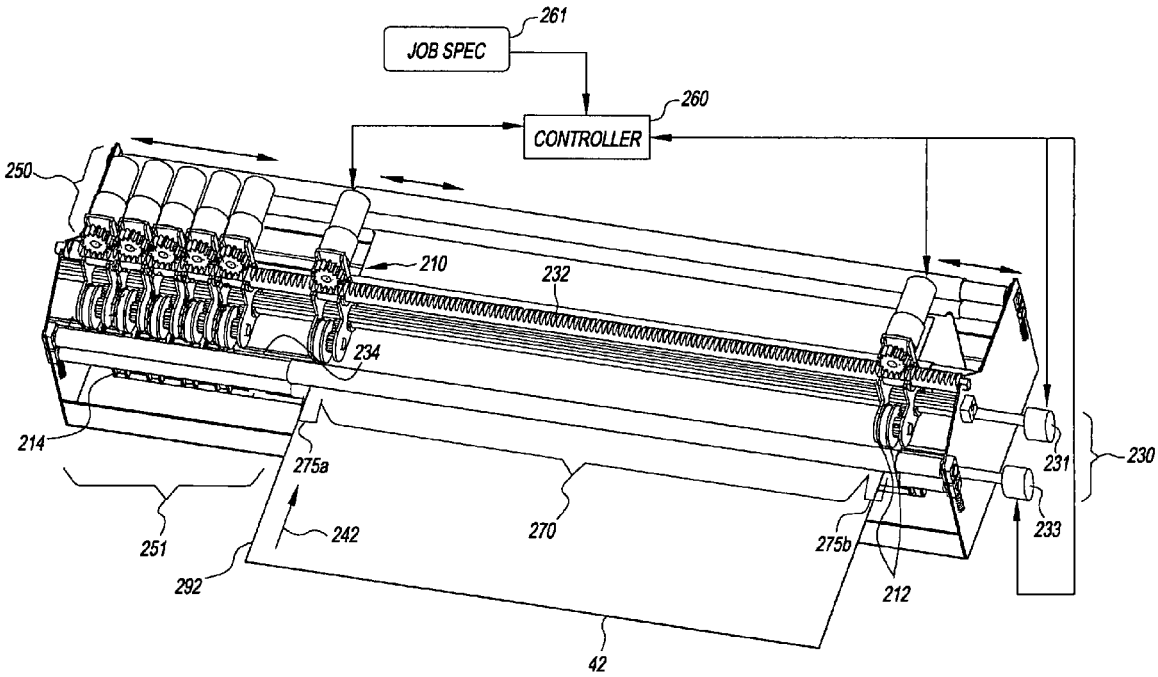

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-7, 10 and 11 are cancelled.

Claims 8 and 9 were not reexamined.

* * * * *